US006421966B1

(12) United States Patent
Braunstein et al.

(10) Patent No.: US 6,421,966 B1
(45) Date of Patent: Jul. 23, 2002

(54) SUNSHADE FOR BUILDING EXTERIORS

(75) Inventors: Richard Braunstein, Atlanta; Gregory B. McKenna, Cumming; David W. Hewitt, Alpharetta, all of GA (US); Randolph S. Harper, Keezletown, VA (US)

(73) Assignee: Kawneer Company Inc., Norcross, GA (US)

( * ) Notice: Subject to any disclaimer, the term of this patent is extended or adjusted under 35 U.S.C. 154(b) by 0 days.

(21) Appl. No.: 09/561,137

(22) Filed: Apr. 28, 2000

(51) Int. Cl.[7] ..... E04F 10/08

(52) U.S. Cl. ..... 52/173.3; 52/74; 52/78; 52/473; 136/244

(58) Field of Search ..... 52/74, 78, 473, 52/173.3; 126/623, 702; 136/244

(56) References Cited

U.S. PATENT DOCUMENTS

| | | | | | |
|---|---|---|---|---|---|
| 2,708,775 | A | * | 5/1955 | Maas | 52/473 X |
| 2,755,523 | A | * | 7/1956 | Gralinski | 52/78 |
| 3,729,874 | A | * | 5/1973 | Albany | 52/473 X |
| 4,393,629 | A | * | 7/1983 | Gasparini et al. | 52/74 |
| 4,505,255 | A | | 3/1985 | Baer | |
| 5,221,363 | A | * | 6/1993 | Gillard | 52/473 X |
| 5,258,076 | A | * | 11/1993 | Wecker | 136/245 |
| 5,413,161 | A | | 5/1995 | Corazzini | |
| 5,437,322 | A | | 8/1995 | Murray | |
| 5,672,101 | A | | 9/1997 | Thomas | |
| 6,014,832 | A | | 1/2000 | Brooks | |

FOREIGN PATENT DOCUMENTS

| | | | | |
|---|---|---|---|---|
| DE | 2532153 | * | 2/1976 | 52/74 |
| JP | 63-67788 | * | 3/1988 | 136/244 |

* cited by examiner

*Primary Examiner*—Laura A. Callo
(74) *Attorney, Agent, or Firm*—Glenn E. Klepac

(57) ABSTRACT

A sunshade for shading window exteriors includes at least one connecting bracket for attachment to a window mullion, a blade support strut attached to the connecting bracket at a first joint, and a plurality of louvered blades supported by the blade support strut at a second joint. The pivot angle at the first joint may be varied to extend the louvered blades a desired distance from the window mullion. The louvered blades are positioned at a preselected fixed profile angle on the second joint in order to optimize shading at the latitude where the sunshade is installed. In a preferred embodiment, the louvered blades have top walls supporting photovoltaic cells and the sunshade includes electric cables for connecting the photovoltaic cells to an electric circuit.

20 Claims, 17 Drawing Sheets

SUNSHADE FOR BUILDING EXTERIORS

GOVERNMENT RIGHTS

The Government has rights in this invention pursuant to Contract No. DE-FC36-97G010245 awarded by the United States Department of Energy.

FIELD OF THE INVENTION

The present invention relates to sunshades for use on building exteriors. More particularly, the invention relates to a sunshade for protecting windows from direct exposure to the sun. In a preferred embodiment, the sunshade also includes photovoltaic cells for generating electricity.

BACKGROUND OF THE INVENTION

There is an increased awareness of the need for sustainable design in today's architecture. Accordingly, architects are increasingly specifying building products having a reduced impact on the environment. Exterior shading devices such as sunshades meet this need.

Many architects and building designers choose sunshades to differentiate their wall elevations aesthetically. Architects also choose to incorporate sunshades in order to reduce solar heat gain. For some applications sunshades are a more desirable method of reducing glare than reflective glass because sunshades allow a high degree of natural lighting that is not possible with reflective coatings.

Sunshade systems have heretofore mostly been custom made. Accordingly, they are expensive design options. A pre-engineered sunshade system having design flexibility engineered into the product provides a balanced approach to cost and aesthetics. Additionally, a pre-engineered sunshade system that is packaged as part of a curtain wall system gives the architect and building owner the confidence of single source responsibility. These desirable benefits to architects and owners are not currently available in custom manufactured sunshade systems.

The need for sustainable design in building construction can also be satisfied by incorporating photovoltaic (PV) modules into the building structure. Accordingly, there is a need for sunshade systems having integrated PV modules. This configuration can satisfy the architect's desire for a truly sustainable design element.

A principal objective of the present invention is to provide a sunshade system for buildings having sufficient design flexibility that it can be utilized at a variety of different locations and can be modified to have different appearances.

A related objective of the present invention is to provide a sunshade system having pre-engineered components so that it is manufactured and installed more economically than custom sunshade systems.

A further objective of the invention is to provide a pre-engineered sunshade system including photovoltaic cells for generating electricity.

Additional objectives and advantages of the invention will become apparent from the following detailed description of a preferred embodiment.

SUMMARY OF THE INVENTION

In accordance the present invention there is provided a sunshade for attachment to an exterior of a building. The sunshade is preferably attached to window mullions so as to protect a window from direct exposure to the sun.

The sunshade includes at least one connecting bracket for attachment to a window mullion, at least one blade support strut attached to the connecting bracket at a first joint, and a plurality of louvered blades supported by the blade support strut. Optionally, the sunshade may also include one or more photovoltaic cells supported by the blades and an electric cable for connecting each photovoltaic cell to an electric circuit.

The sunshade is suited for attachment to two laterally spaced, generally vertically extending window mullions in a curtain wall of a building. The mullions are components of a window frame. The mullions are preferably aluminum alloy extrusions strengthened by steel reinforcements or reinforcing bars.

The sunshade includes at least one connecting bracket suited for attachment to a mullion. A curtain wall system with two mullions has a connecting bracket extending from each mullion. The connecting brackets are made from aluminum alloy plate shaped to a desired configuration.

The connecting brackets are each joined to a blade support strut at a first joint. Each blade support strut is preferably an aluminum alloy plate cut to include a plurality of struts or blade support arms extending away from the first joint. A pivot angle between the connecting bracket and the blade support at the first joint is preselected in accordance with the degree of shading desired at a location where the sunshade is installed. For example, architects and building owners generally need greater sunshade extension in northern latitudes to attain the same degree of shading as in southern latitudes.

The louvered blades are preferably made from a plurality of interconnected aluminum alloy extrusions. At least one of the extrusions has opposed end portions supported by a pair of laterally spaced blade support struts at a second joint. The louvered blades are positioned on the second joint to a fixed profile angle that is preselected to optimize shading at the latitude where the sunshade is situated.

In a preferred embodiment, the louvered blades each include a top wall defining a recess holding a photovoltaic cell. A sunshade having three louvered blades each supporting a 20-watt photovoltaic cell is capable of generating 60 watts at peak daylight hours when electricity consumption is highest. The sunshade includes electric cables connecting the photovoltaic cells to an electric circuit inside the building.

DETAILED DESCRIPTION OF PREFERRED EMBODIMENTS

Figure 1:
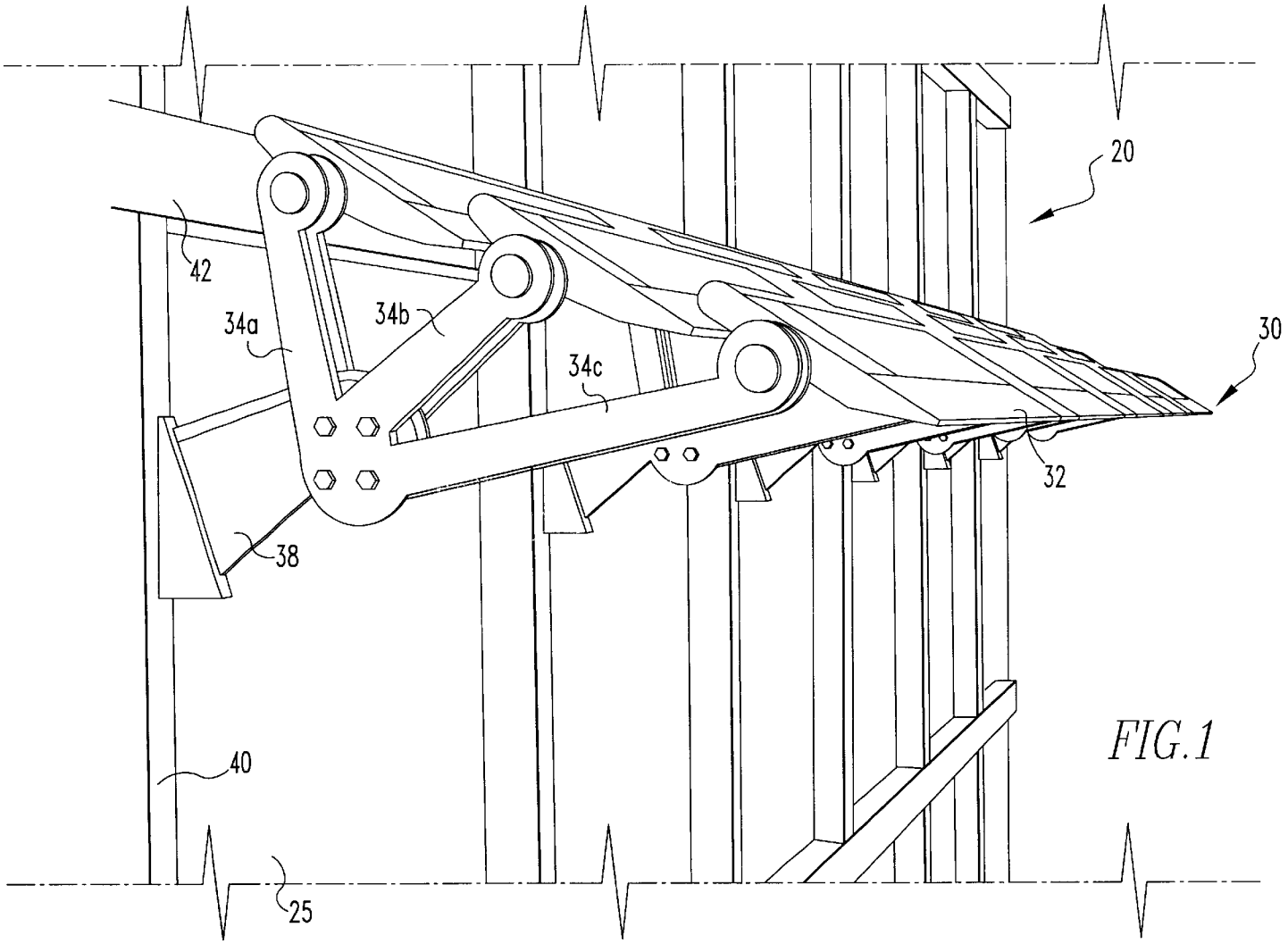
FIG. 1 is a perspective view of a building exterior having windows covered by sunshade of the invention.

A particularly preferred embodiment of the present invention is shown in FIG. 1, where a curtain wall 20 has several glass window panes 25 shaded by sunshades 30. Each sunshade 30 includes three louvered blades 32 supported by struts or arms 34*a*, 34*b*, 34*c*, of laterally spaced blade support struts 36. The blade support struts 36 extend outwardly from connecting brackets 38 attached to mullions or window mullions 40. Each window pane 25 in the curtain wall 20 is flanked by two laterally spaced, generally vertical mullions 40 joined by generally horizontal window rails 42.

Figure 2:
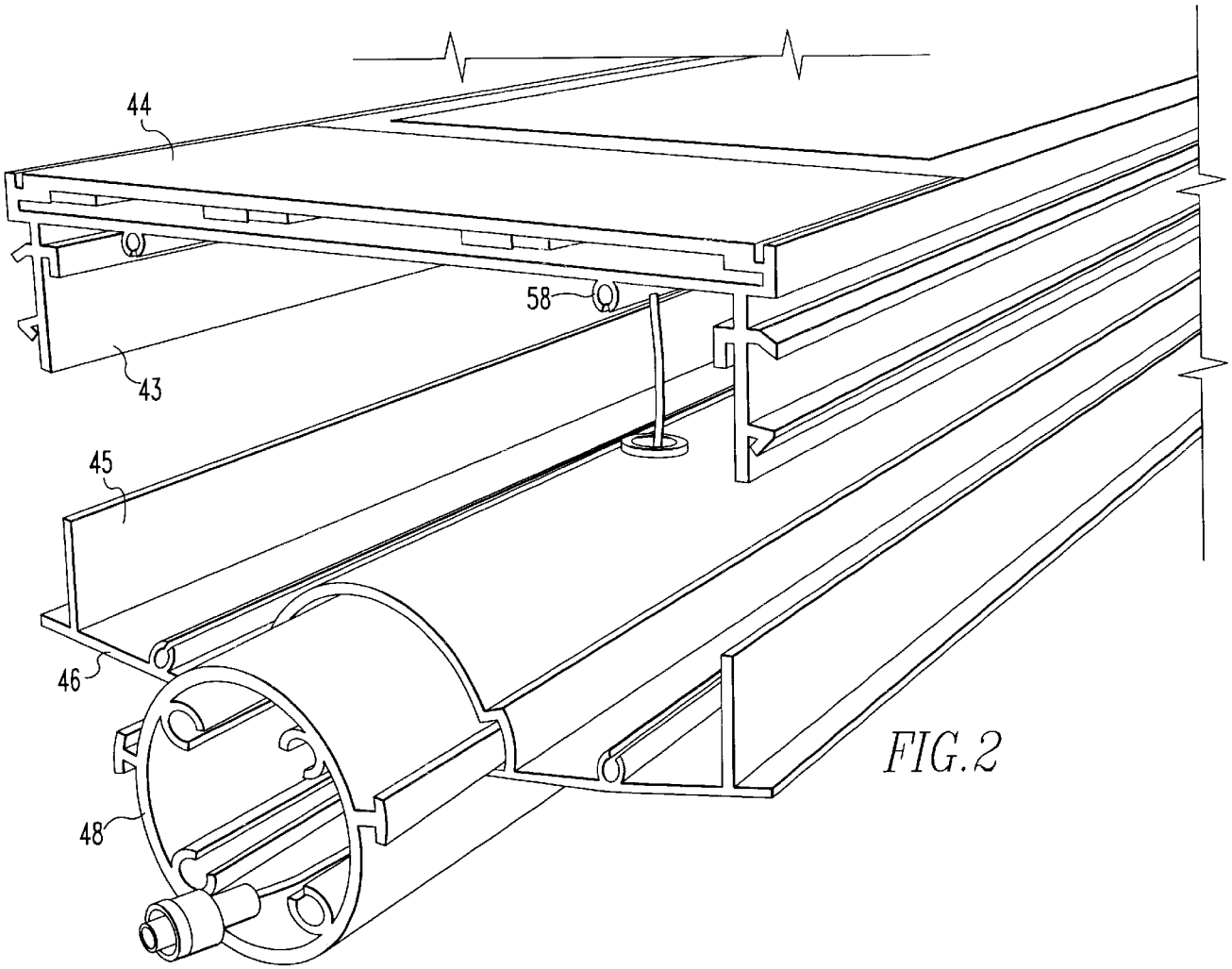
FIGS. 2–6 are exploded, perspective views showing assembly of a louvered blade for a sunshade of the invention.
Figure 3:
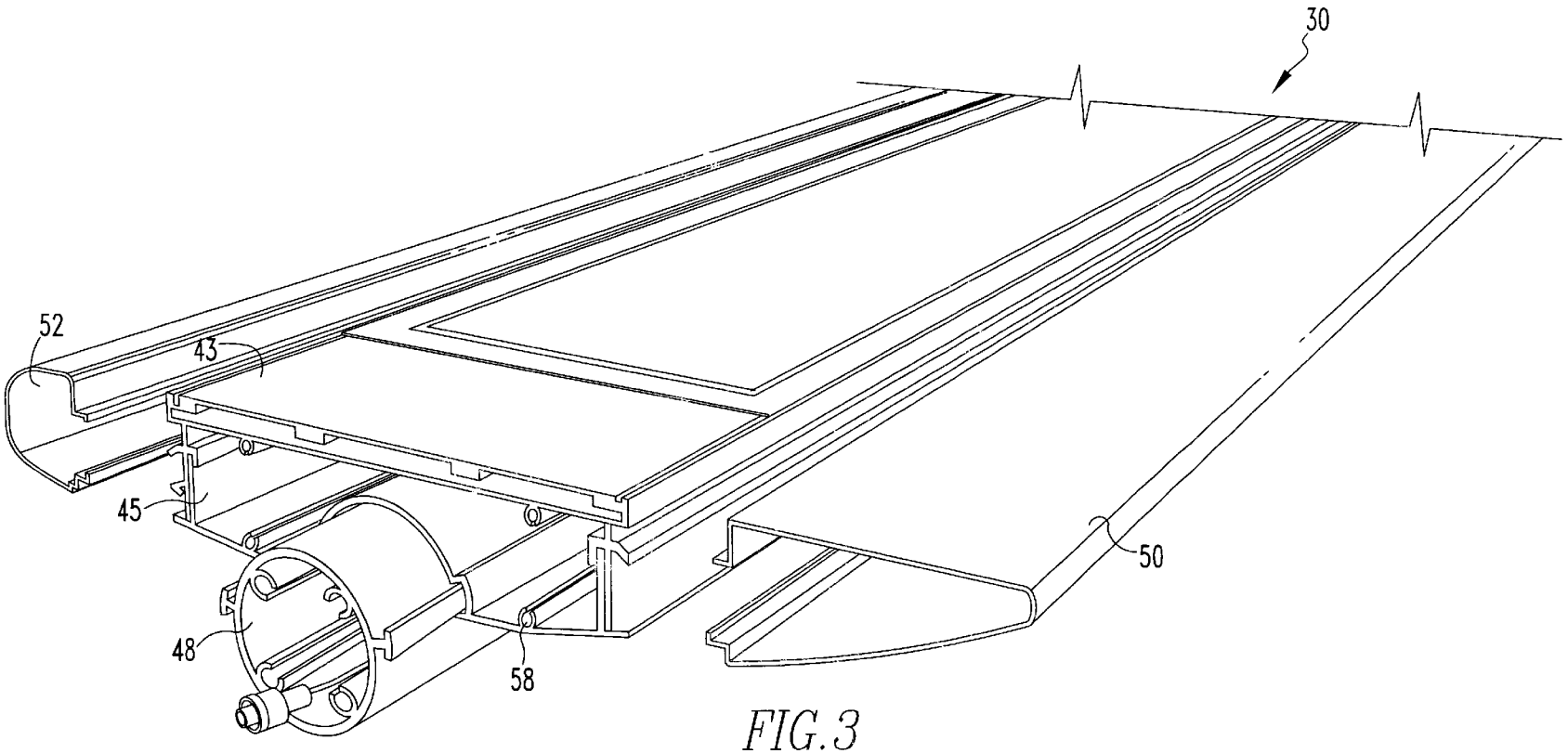
Figure 4:
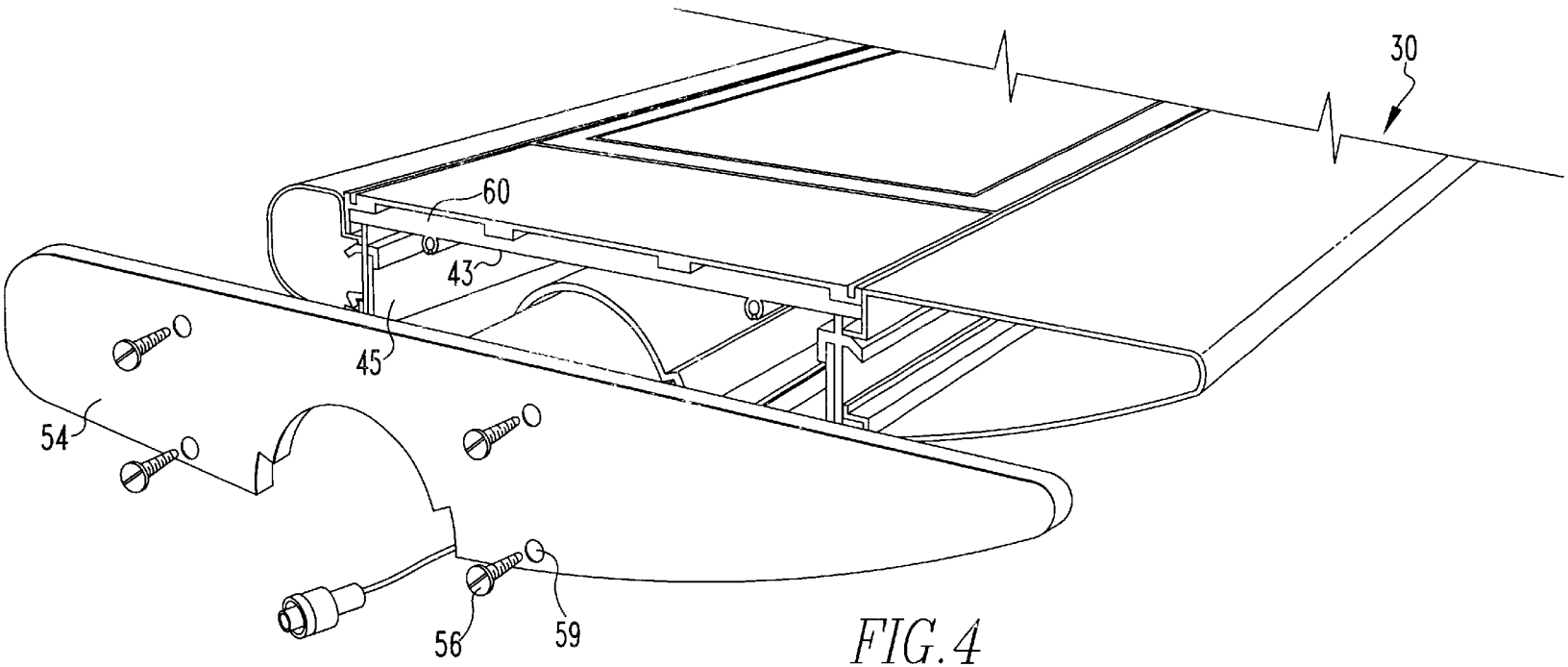

Referring now to FIGS. 2–7 there is shown one of the blades 32 for a sunshade of the present invention. Each blade 32 is assembled from several interconnected aluminum alloy extrusions as shown in FIGS. 2–4. The extrusions include an upper part 43 including a top wall 44, a lower part 45 including a bottom wall 46, a support cylinder 48 connected to the lower part 45, a toe 50, and a heel 52. The toe 50 and heel 52 are asymmetrical in order to avoid shading PV modules below. End caps 54 are attached to lateral end portions of the upper part 43 and lower part 45 by screw fasteners 56, as shown in FIG. 4.

The multi-part assembly shown in FIGS. 2–4 is advantageous for replacement of a PV module housed in the upper part 43. The multi-part assembly facilitates replacement of only the upper part 43 rather than an entire sunshade 30.

The upper part 43 and lower part 45 both include generally cylindrical screw splines 58 (shown in FIGS. 2 and 3) for retaining the screw fasteners 56. The screw fasteners 56 extend through openings 59 in the end caps 54.

Figure 5:
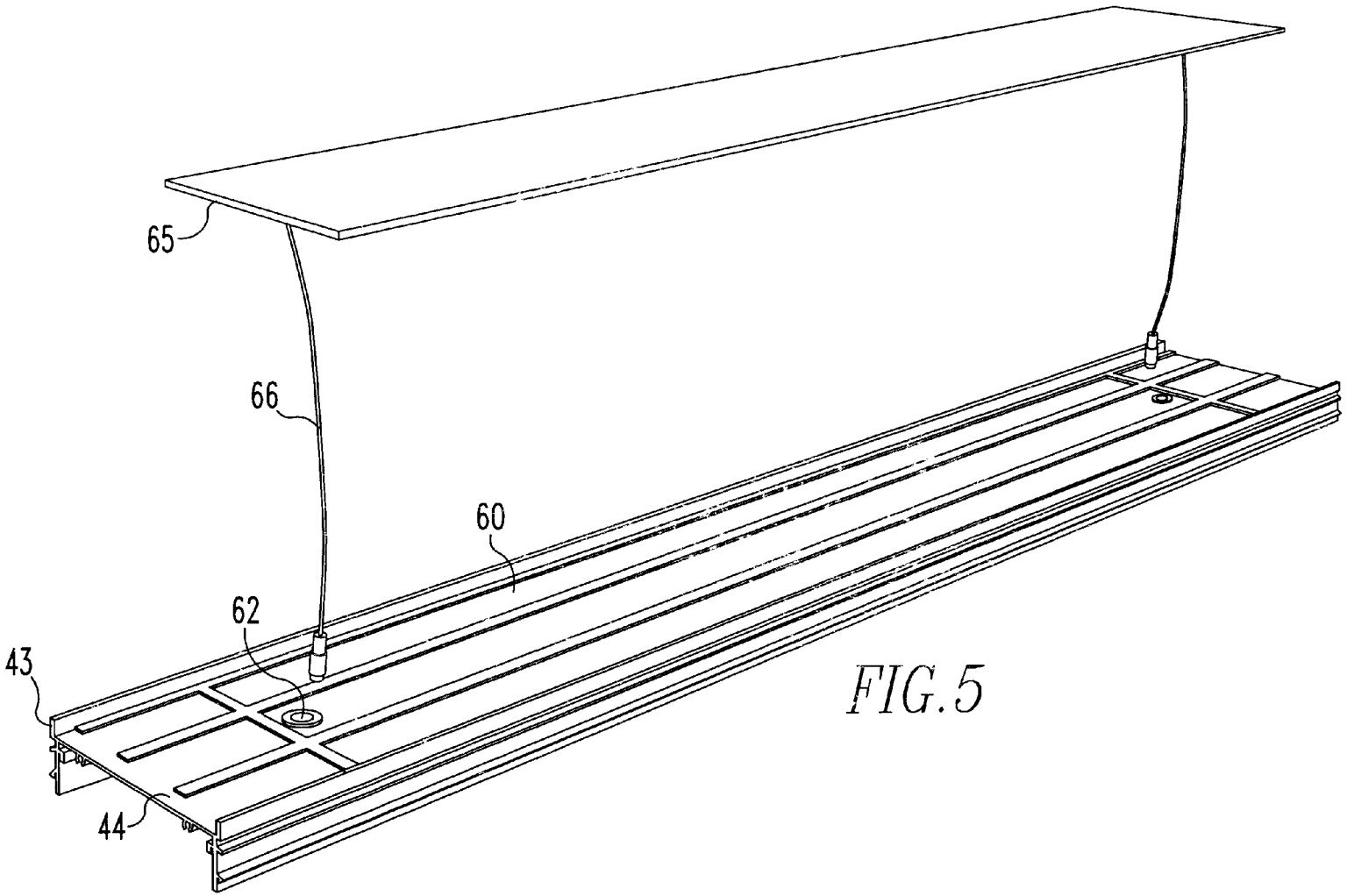
Figure 6:
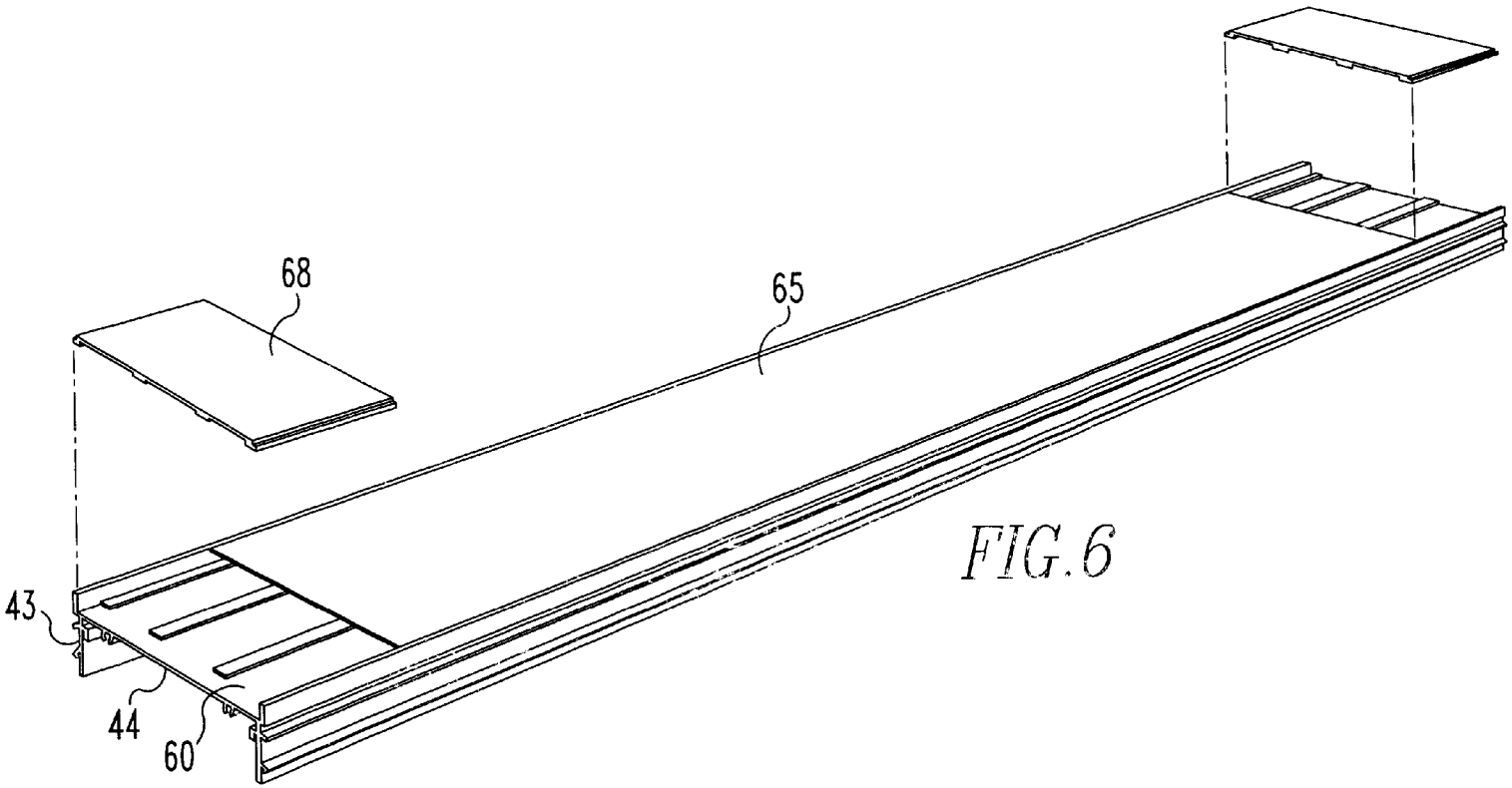
Figure 7:
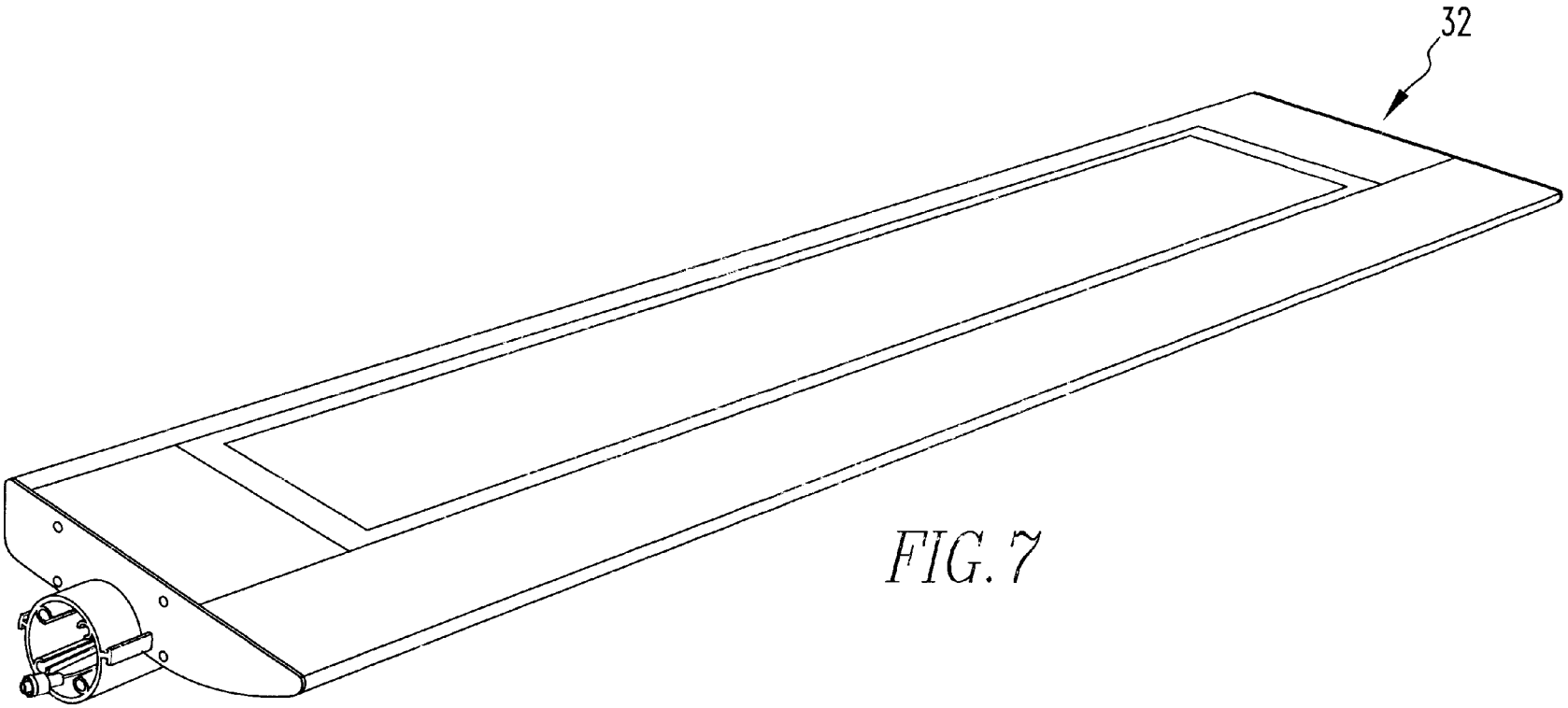
FIG. 7 is a perspective view of a louvered blade of the invention.

Assembly of the upper part 43 is shown in FIGS. 5 and 6. The upper part 43 includes a top wall 44 defining a recess 60 and laterally spaced through openings 62. A photovoltaic module 65 for converting sunlight to electricity is positioned in the recess 60, with electric cables 66 extending through both openings 62. End plates 68 are positioned inside the recess 60 adjacent the PV module 65, and joints between the plates 68 and module 65 are filled with a silicone sealant (not shown). One of the assembled louver blades-32 is shown in FIG. 7.

Figure 8:
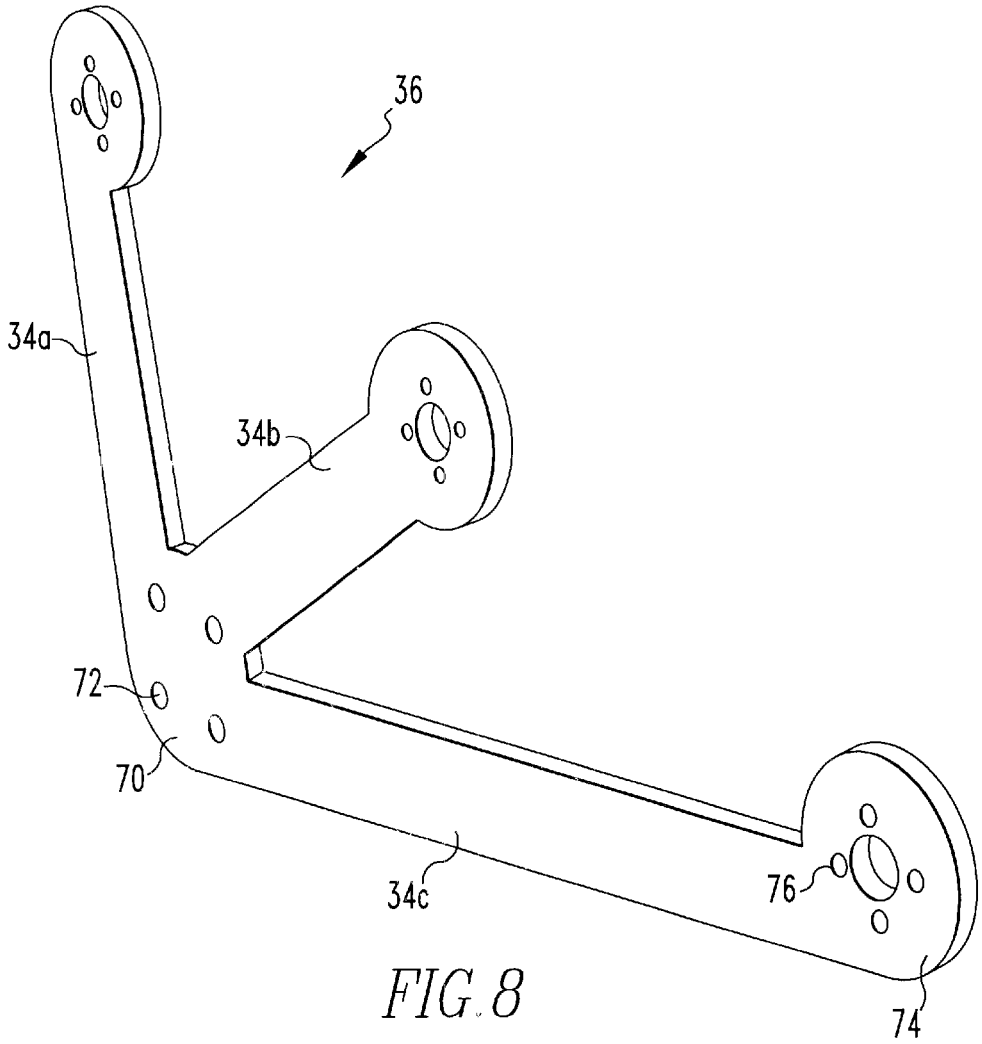
FIG. 8 is a perspective view of a blade support strut of the invention.

In FIG. 8, there is shown a blade support strut 36 having three struts or arms 34*a*, 34*b*, 34*c* extending from a generally circular hub 70. The blade support strut 36 is cut from AA5052 aluminum alloy plate having a thickness of 0.5 in. (1.3 cm.). The hub 70 defines seven through holes 72 for securing the support strut 36 to a connecting bracket 38. The arms 34*a*, 34*b*, 34*c* all end in generally circular nodes 74, each defining three apertures 76 for securing the support strut 36 to an end portion of a blade 32, and one larger aperture for passage of electrical conduct.

Figure 9:
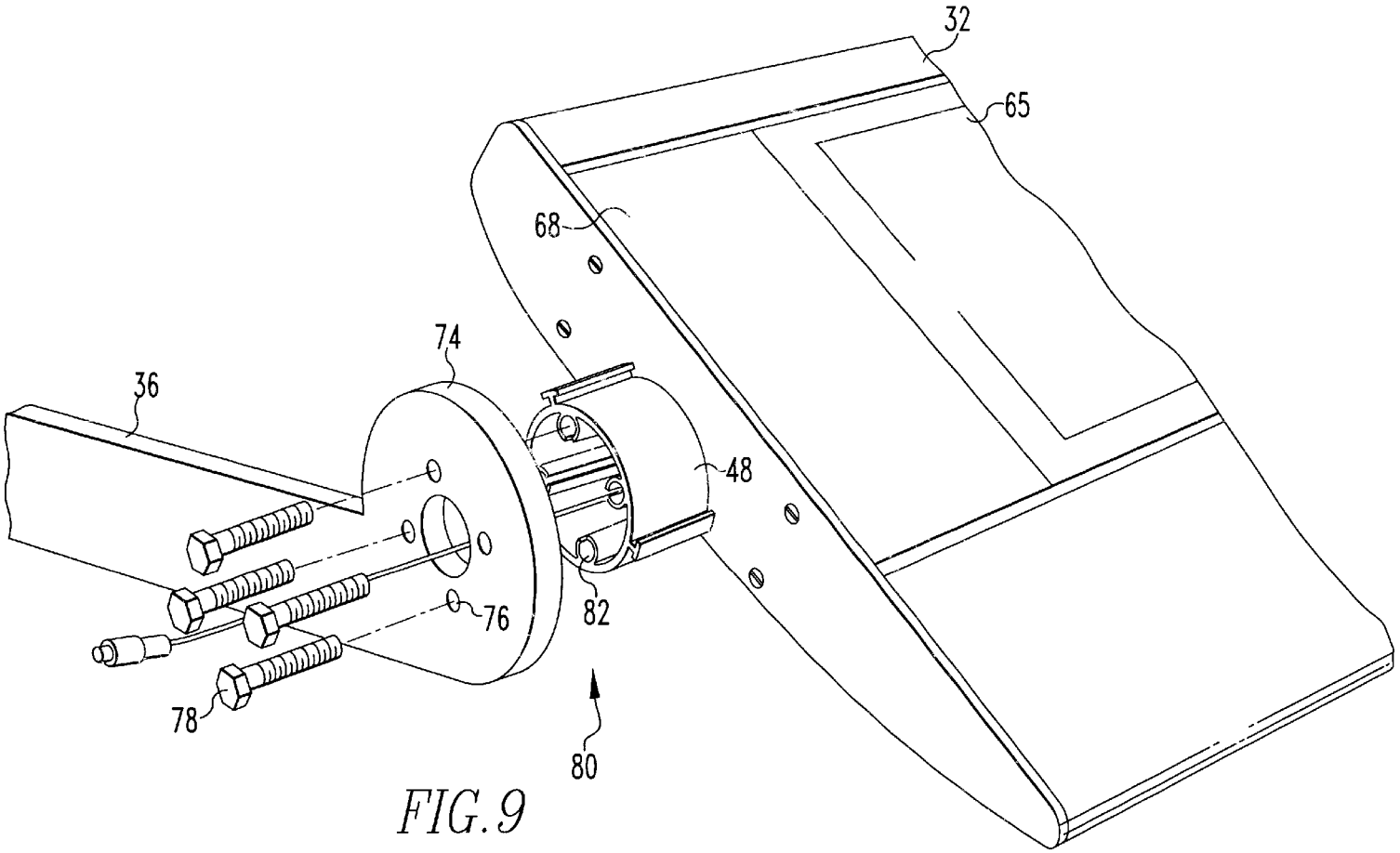
FIG. 9 is an exploded, fragmentary, perspective view showing a second joint of the invention.

A joint 80 between a support strut 36 and a blade 32 is shown in FIG. 9. Three screws 78 extend through apertures 76 in a strut node 74, and into three generally cylindrical screw splines 82 in the support cylinder 48. The joint 80 can be modified by varying locations of the apertures 76 in the strut node 74, so that the blade 32 can be fixed at an infinite range of preselected profile angles. As used herein, the term "profile angle" refers to an angle between the PV modules 65 and the earth's axis.

Figure 10:
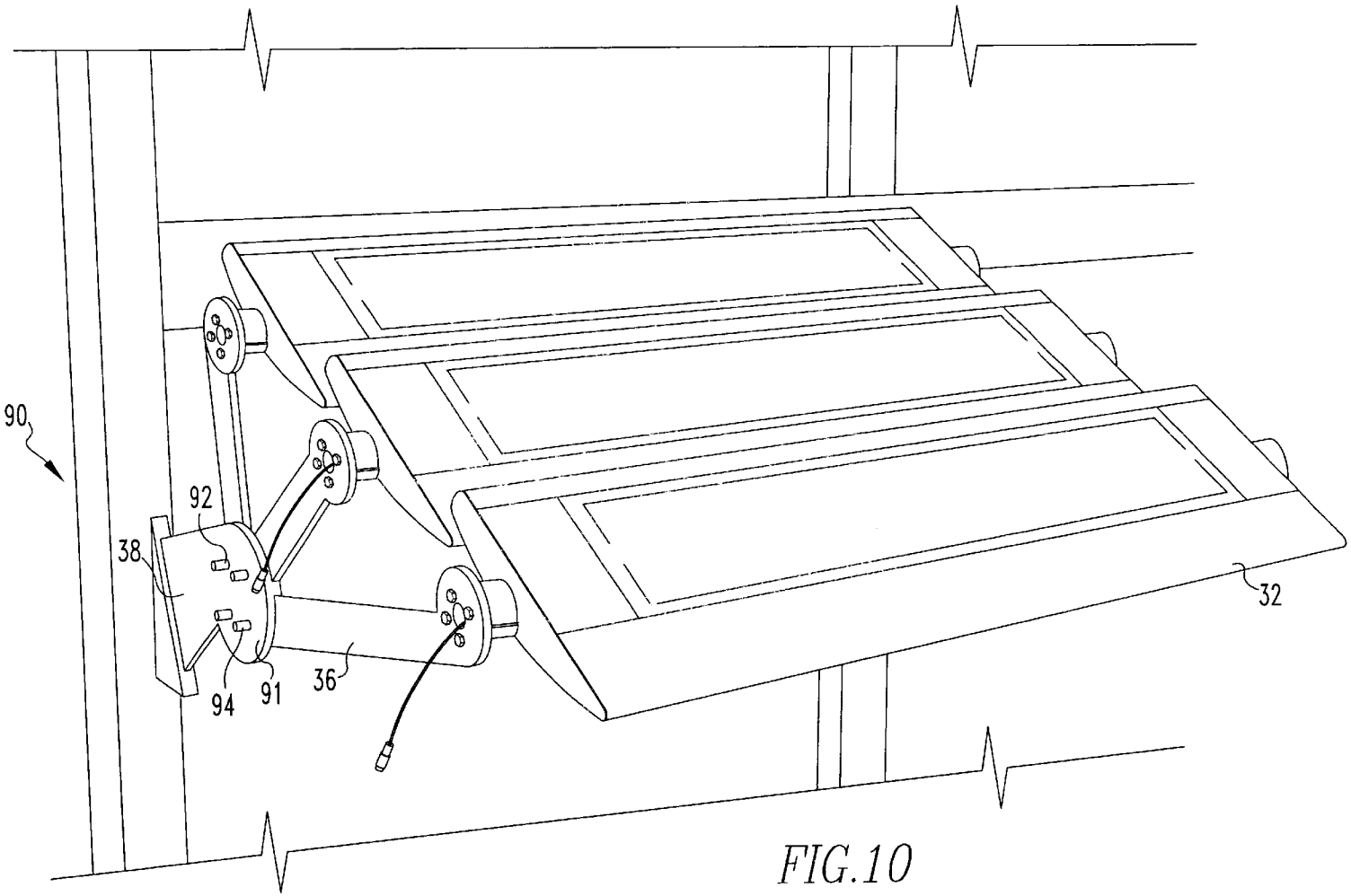
FIG. 10 is an exploded perspective view of a sunshade of the invention.

A joint 90 between a connecting bracket 38 and the blade support strut 36 is shown in FIG. 10. The connecting bracket 38 includes a rounded lobe 91 defining seven apertures 92. Seven bolts 94 extend through the apertures 92 into holes in the hub of the strut 36. By varying locations of the apertures 92 in the connecting bracket 38, a pivot angle between the connecting bracket 38 and the support strut 36 can be set at an infinite range of preselected angles. In general, the pivot angle at the joint 90 will be set to extend the blades 32 farther from the mullions 40 at locations where greater shading is desired.

Figure 11:
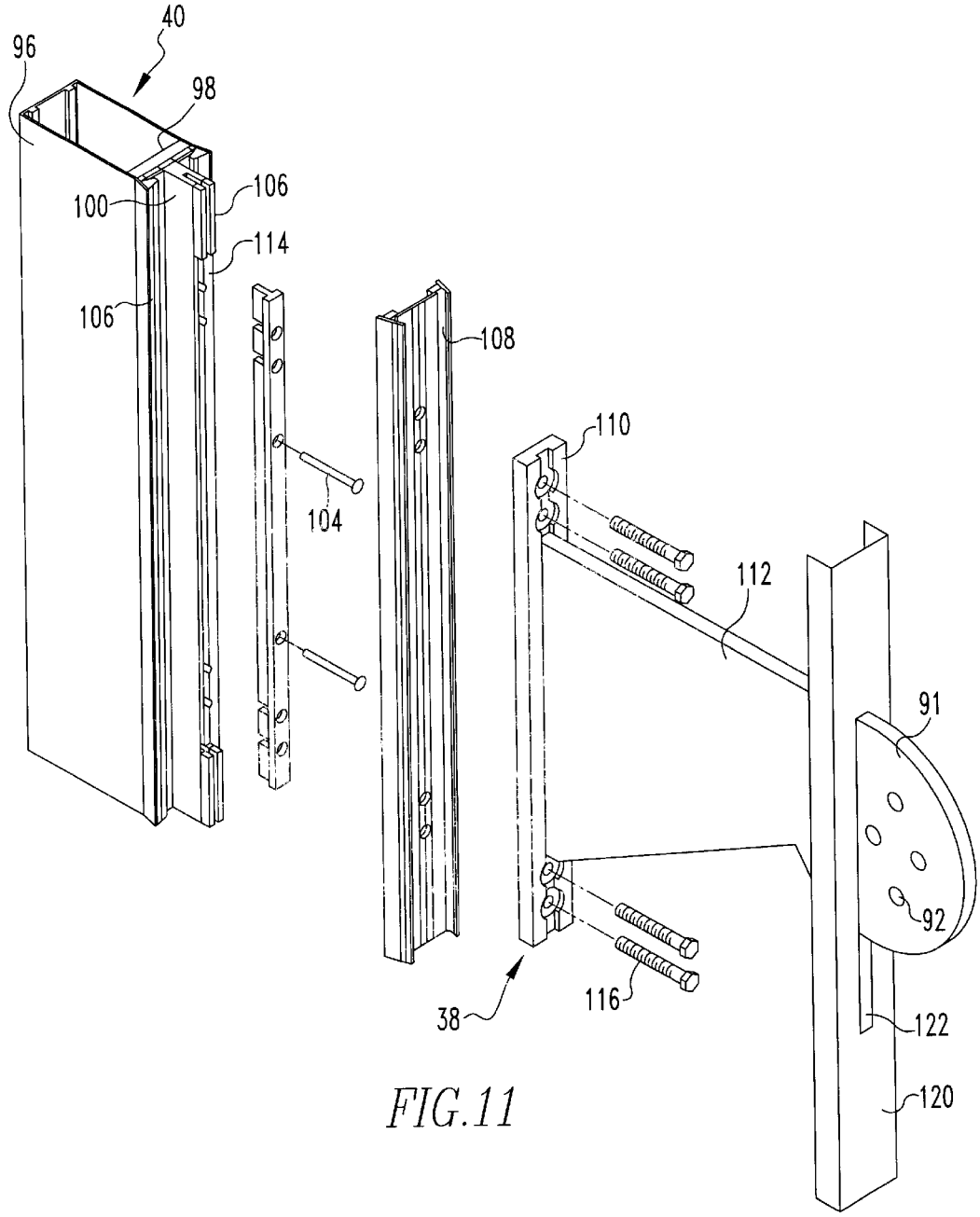
FIG. 11 is an exploded, perspective view of a mullion and connecting bracket of the invention
Figure 12:
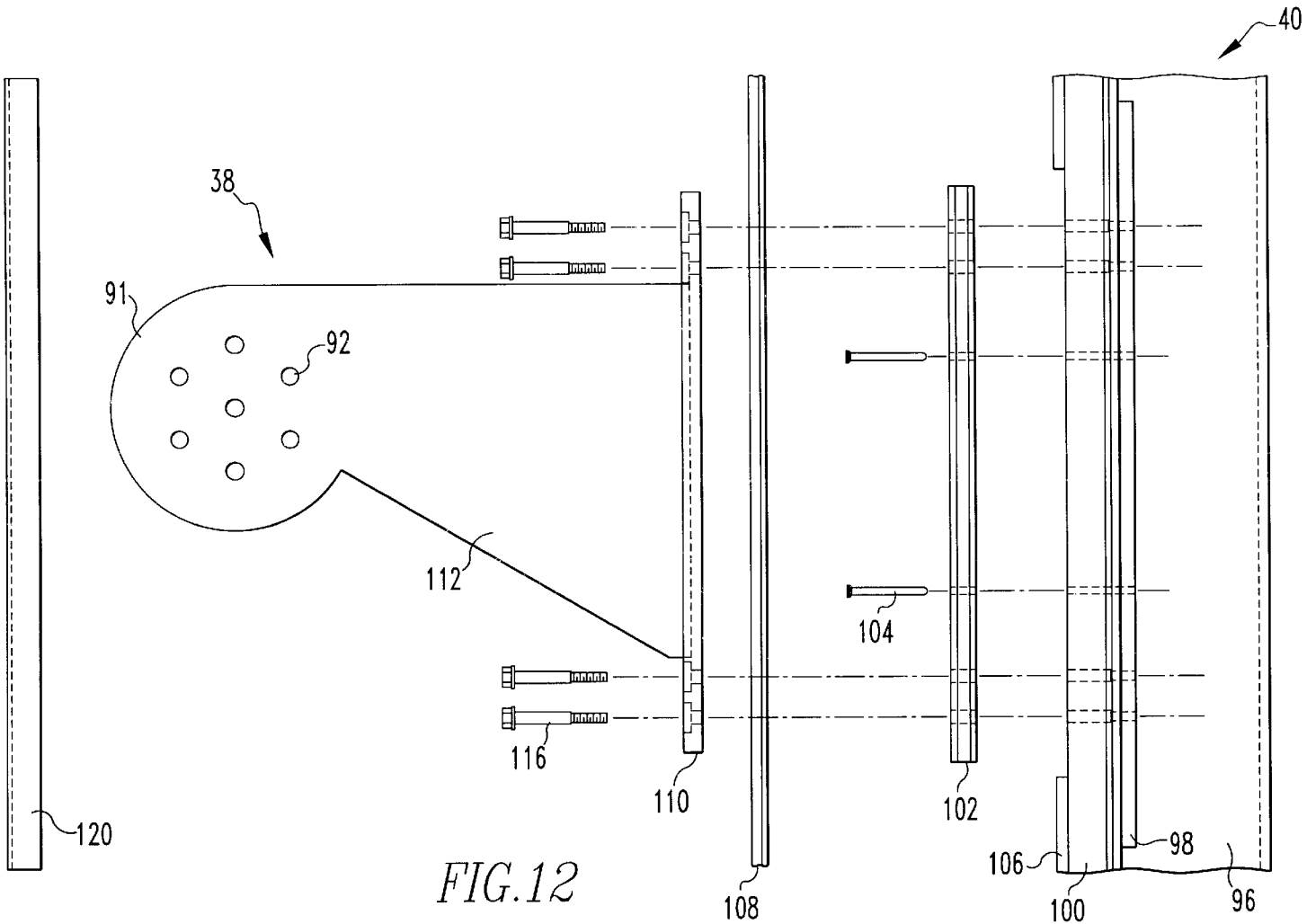
FIGS. 12 and 13 are exploded, side elevational views of a mullion and connecting bracket of invention.
Figure 13:
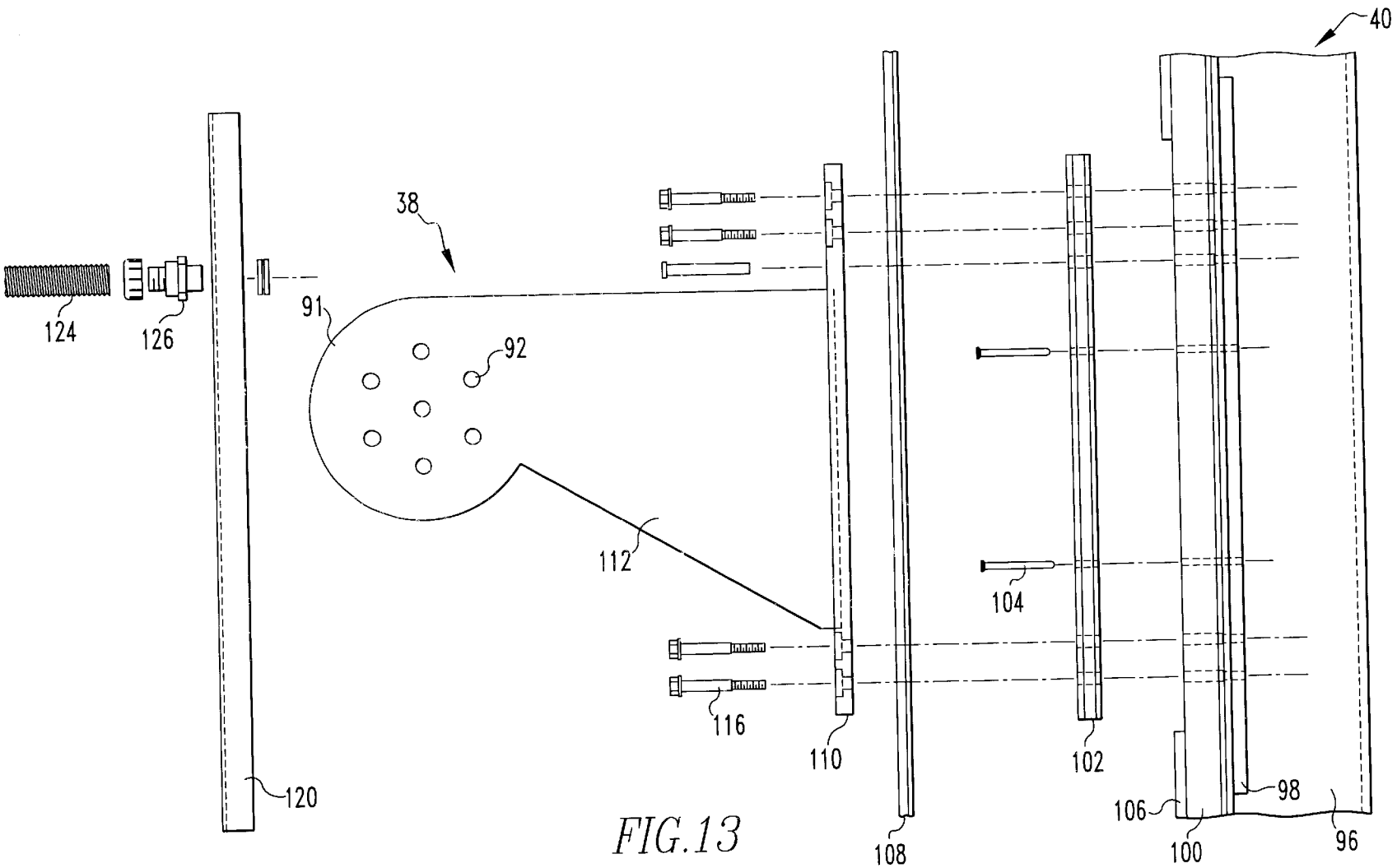

Assembly of a mullion 40 and a connecting bracket 38 is shown in FIGS. 11–13. The mullion 40 includes an extruded aluminum alloy hollow principal portion 96, a steel reinforcement or reinforcing bar 98 inside the principal portion 96, two vertically spaced tongues 100 extending exteriorly of the principal portion 96, an elongated tongue filler 102 for filling the vertical gap between the tongues 100, and machine screws 104 for attaching the tongue filler 102 and the steel reinforcement bar 98 to the principal portion 96. The principal portion 96 and tongues 100 both carry elongated polymeric insulating strips 106 to reduce heat conduction through the mullion 40. An extruded aluminum alloy pressure plate 108 covers the tongues 100, tongue filler 102, and machine screws 104.

The connecting bracket 38 includes an anchor 110 adjacent the pressure plate 108, a rounded lobe 91 defining apertures 92, and an elongated, exteriorly extending shank 112 between the strut anchor 110 and the lobe 91. The anchor 110, pressure plate 108, tongue filler 102, and a front wall 114 of the mullion principal portion 96 all define aligned openings for several hex head bolts 116 threaded into the front wall 114 when the sunshade is fully assembled. Heads of the bolts 116 are covered by an exterior cover or cover plate 120 having an opening for the shank 112. The exterior cover is preferably an aluminum alloy extrusion.

FIG. 12 shows a first embodiment of a mullion 40 and connecting bracket 38 of FIG. 11.

FIG. 13 shows a second embodiment of a mullion 40 and connecting bracket 38 of the invention, for use with a sunshade having blades supporting PV modules. The embodiment of FIG. 13 is similar to FIG. 12, except that the front plate 120, strut anchor 110, pressure plate 108, tongue filler 102, and mullion front wall 114 all define aligned openings for an electric cable connecting the PV modules to an electric circuit in a building where the sunshade is situated. The embodiment of FIG. 13 shows a location where an electrical connection is introduced into a building through one of the mullions. The electric cable extends through a hollow conduit 124 attached to the front plate 120 by a liquid-tight connector 126.

Figure 14:
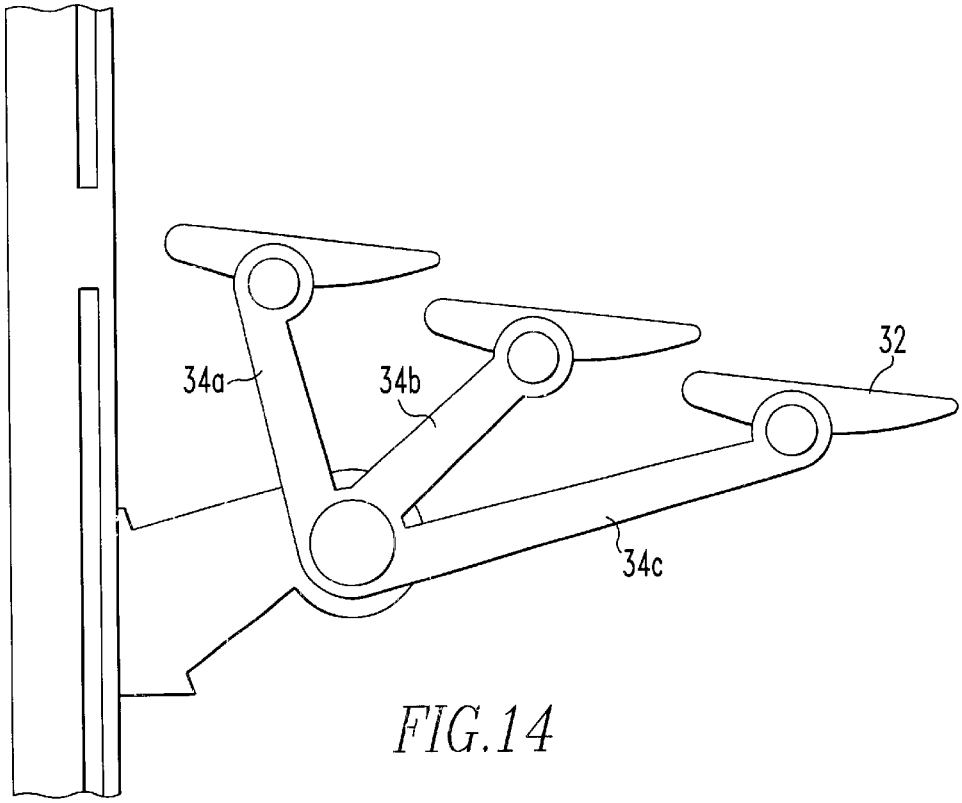
FIGS. 14–17 are side elevational views of a sunshade of the invention.
Figure 15:
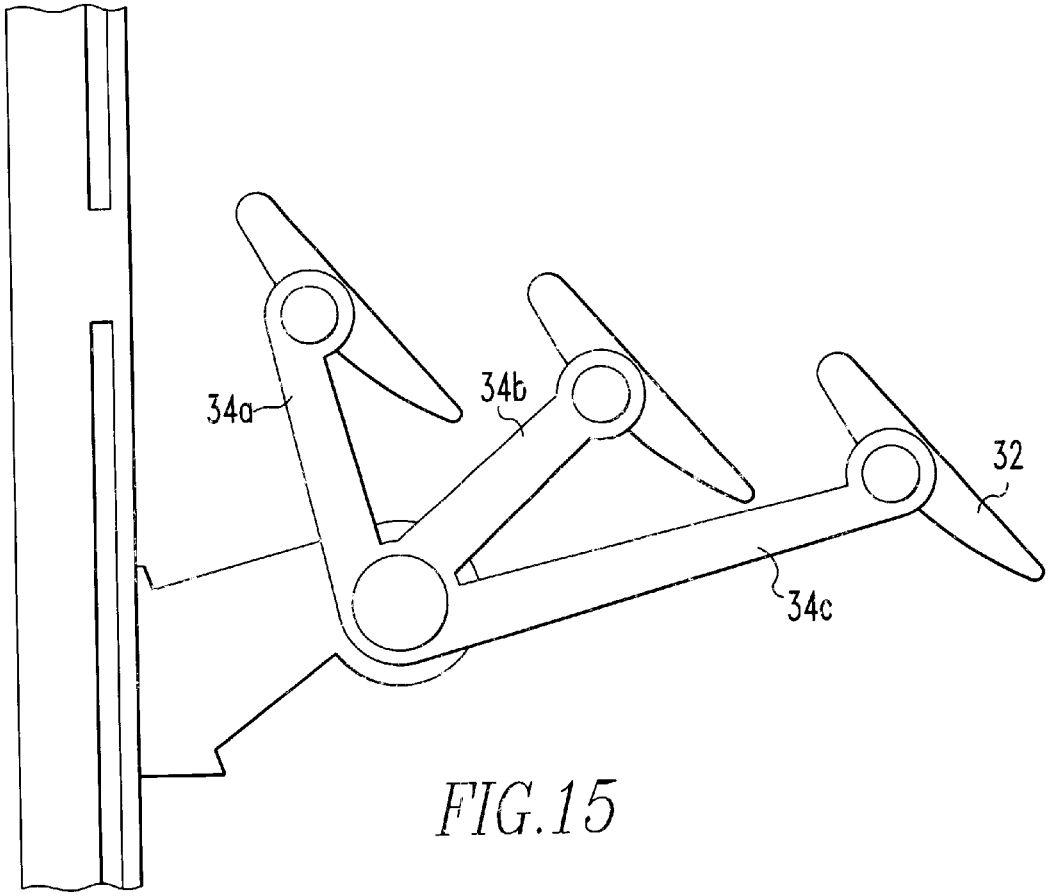

The joint between the strut arms 34*a*, 34*b*, 34*c* and the louvered blades 32 can be set at a variety of preselected profile angles, as shown in FIGS. 14 and 15. The large profile angle of the blades 32 shown in FIG. 14 is desirable for a climate in the southern United States, such as Key West, Fla. The smaller profile angle shown in FIG. 15 may be selected for a northern latitude, such as at Boston, Mass.

Figure 16:
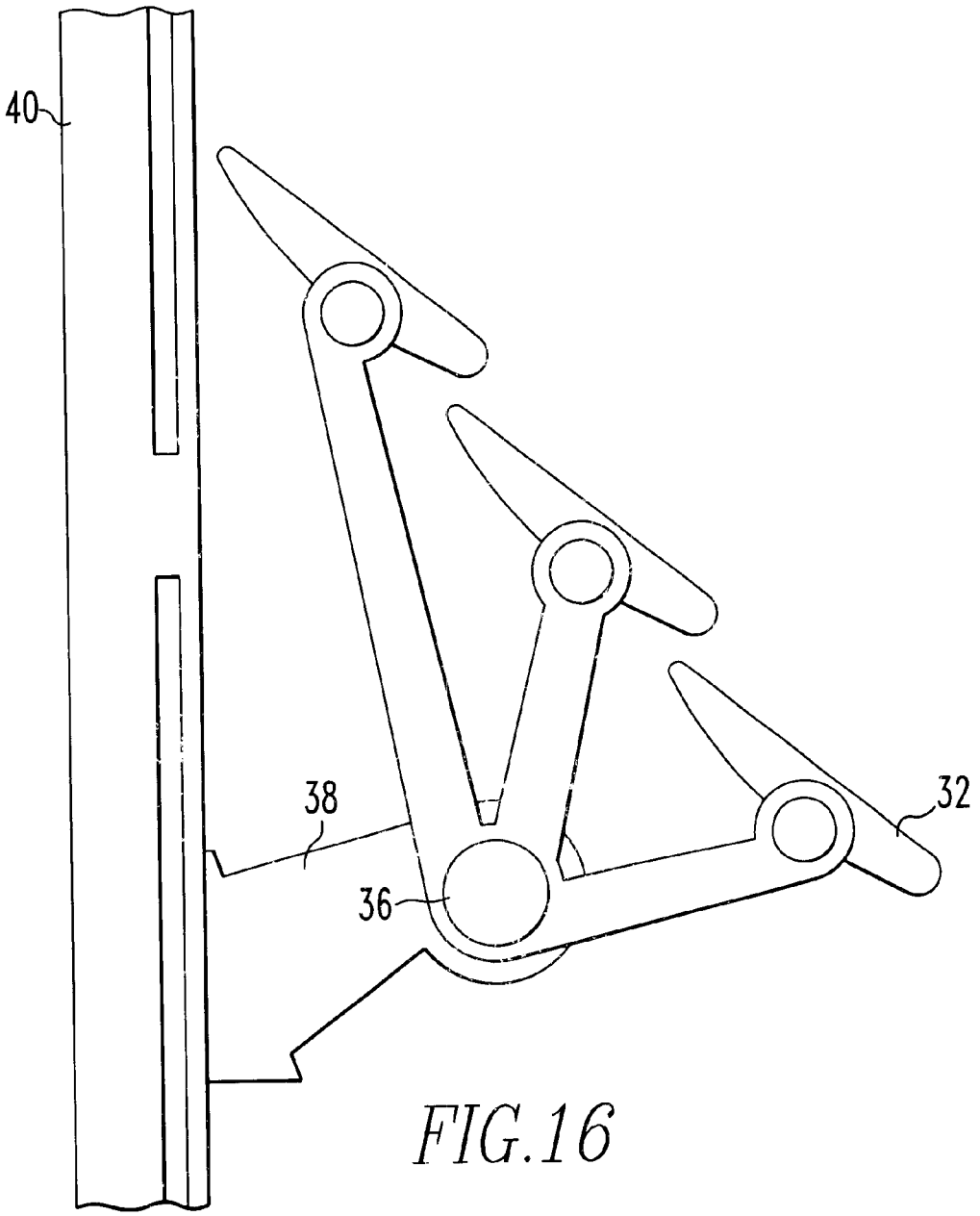
Figure 17:
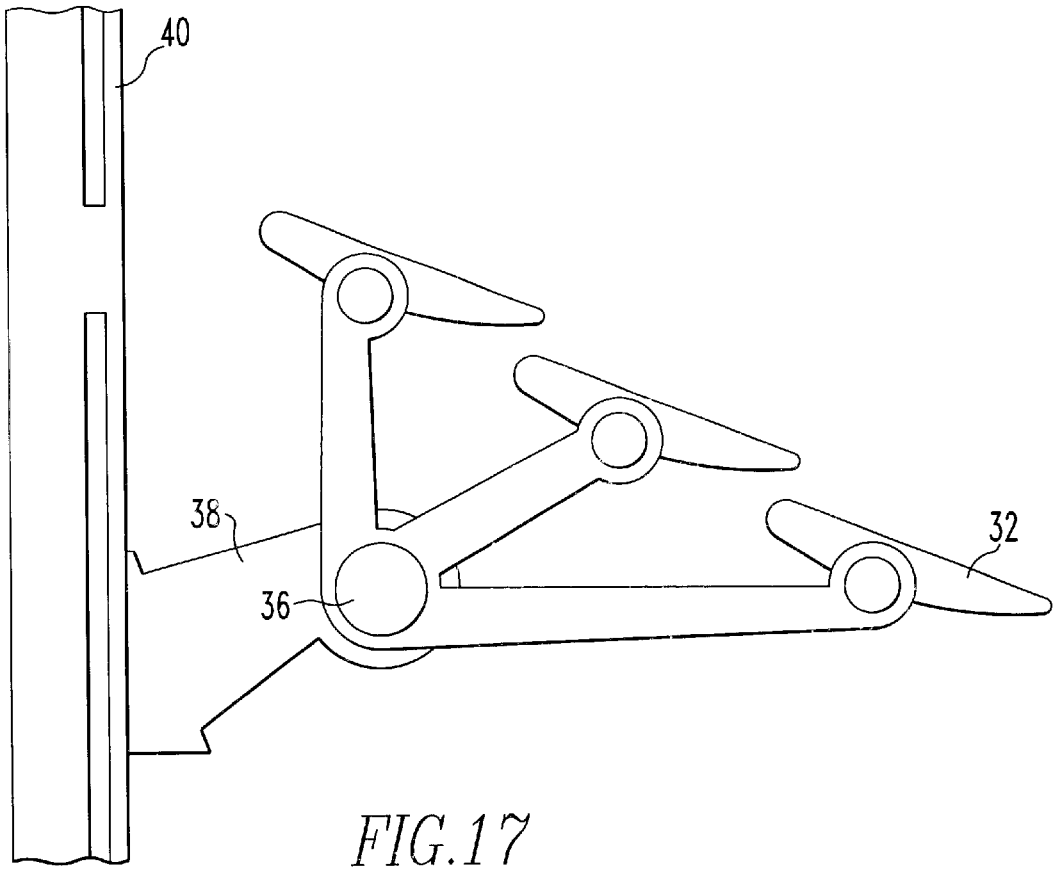

The joint between the connecting bracket 38 and blade support 36 may also be varied considerably, as shown in FIGS. 16 and 17. All of the blades 32 in the position shown in FIG. 16 are within 33 inches of the mullion 40. In FIG. 17, the blades 32 extend as far as 47 inches away from the mullion 40. A variety of other fixed positions between the extremes of FIGS. 16 and 17 may also be selected, depending upon the geographical location of the sunshade.

Having described the presently preferred embodiments, it is to be understood that the invention may be otherwise embodied within the spirit and scope of the appended claims.

What is claimed is:

1. A sunshade for attachment to a curtain wall of a building, comprising a) at least one connecting bracket suitable for attachment to a mullion in a curtain wall, b) at least one blade support strut attached to said connecting bracket at a first joint, c) a plurality of louvered blades each supported by the blade support strut at a second joint, said louvered blades each being positioned on said second joint at a preselected fixed profile angle, each said louvered blades comprising a plurality of interconnected aluminum alloy extrusions.

2. The sunshade of claim 1, wherein said blade support strut is attached to the connecting bracket at a preselected fixed pivot angle.

3. The sunshade of claim 1 comprising d) two generally vertical, laterally spaced mullions, each said mullions being attached to a connecting bracket in said sunshade.

4. The sunshade of claim 3 wherein each said mullions comprises an aluminum alloy extrusion and a steel reinforcement.

5. The sunshade of claim 1 wherein each said connecting bracket comprises an aluminum alloy plate.

6. The sunshade of claim 1 wherein said blade support strut comprises an aluminum alloy plate.

7. The sunshade of claim 1 wherein said blade support strut includes a plurality of arms extending from said first joint, each said arms supporting one of said louvered blades.

8. The sunshade of claim 1 wherein at least one of said aluminum alloy extrusions has opposed end portions supported by laterally spaced blade supports.

9. The sunshade of claim 1 wherein at least one of said louvered blades comprises a top wall, said sunshade further comprising a photovoltaic cell supported by said top wall, said fixed profile angle being preselected to optimize electricity production by said photovoltaic cell at a latitude where said sunshade is attached to a building exterior.

10. The sunshade of claim 9 further comprising an electric cable for connecting said photovoltaic cell to an electric circuit.

11. A sunshade supporting a plurality of photovoltaic cells outside a window in a curtain wall, said sunshade comprising a) a connecting bracket suitable for attachment to a window mullion in a curtain wall and extending exteriorly thereof, said connecting bracket defining a plurality of apertures, b) a blade support strut attached to said connecting bracket at a first joint, said blade support strut supporting a plurality of louvered blades, said blade support strut including a hub defining a plurality of holes, said hub being fixed to said connecting bracket by fasteners extending through said holes and said apertures in the connecting bracket, and c) said plurality of louvered blades each including 1) a top wall supporting a photovoltaic, cell, and 2) a pair of opposed end portions each supported by said blade support strut at a second joint at a fixed profile angle preselected to optimize electricity production by said photovoltaic cell, and 3) an electric cable for connecting said photvoltaic cell to an electric circuit.

12. The sunshade of claim 11, wherein said blades each comprise a plurality of interconnected aluminum alloy extrusions.

13. The sunshade of claim 11, wherein said blades each comprise an upper part, a lower part, and a support cylinder connected to said lower part, said support cylinder having opposed lateral end portions each attached to said blade support strut.

14. The sunshade of claim 13, wherein said upper part includes said top wall and said upper part is separable from said lower part to facilitate replacement of said photovoltaic cell supported by said top wall.

15. The sunshade of claim 11, wherein said blade support strut includes a plurality of arms ending in nodes defining a plurality of apertures and said blades each include a plurality of splines, said blades being attached to said arms by fasteners extending through said apertures and said splines.

16. A sunshade comprising a) two generally vertical, laterally spaced mullions, b) a connecting bracket attached to each said mullions, c) a blade support strut attached to said connecting bracket at a first joint, and d) a plurality of louvered blades each supported by the blade support strut at a second joint, said louvered blades being positioned on said second joint at a preselected fixed profile angle.

17. The sunshade of claim 16, wherein said louvered blades each comprise a plurality of interconnected aluminum alloy extrusions.

18. The sunshade of claim 16, wherein said blade support strut includes a plurality of arms extending from said first joint, each arms supporting a louvered blade.

19. The sunshade of claim 16, wherein at least one of said louvered blades supports a photovoltaic cell.

20. The sunshade of claim 16, wherein said blade support strut includes a hub defining a plurality of holes, said connecting bracket defines a plurality of apertures, and said hub is fixed to said connecting bracket by fasteners extending through said holes and said apertures.

* * * * *